US005239231A

United States Patent [19]

Grunder

[11] Patent Number: 5,239,231

[45] Date of Patent: Aug. 24, 1993

[54] FILAMENT ATTACHMENT METHOD FOR DUAL FILAMENT HALOGEN LAMP HAVING A COMMON GROUND CONNECTION

[75] Inventor: Robert A. Grunder, Cranford, N.J.

[73] Assignee: Cooper Industries, Inc., Houston, Tex.

[21] Appl. No.: 664,689

[22] Filed: Mar. 5, 1991

[51] Int. Cl.[5] ..... H01K 1/18; H01K 1/40

[52] U.S. Cl. ..... 313/579; 313/272; 313/316; 445/27

[58] Field of Search ..... 313/272, 316, 579; 445/27

[56] References Cited

U.S. PATENT DOCUMENTS 1,796,530 3/1931 Melish ..... 313/272
3,912,960 10/1975 Danko ..... 313/579
4,737,685 4/1988 Thomas ..... 313/579

FOREIGN PATENT DOCUMENTS 2118061 10/1971 Fed. Rep. of Germany ..... 313/316

*Primary Examiner*—Palmer C. DeMeo
*Attorney, Agent, or Firm*—Nelson Blish

[57] ABSTRACT

A connector for connecting the filaments of a dual filament halogen lamp to a common ground lead includes two provisions for clamping the connector to ends of the first and second filament and a central portion for connection to the common ground in a dual filament halogen lamp.

4 Claims, 2 Drawing Sheets

FIG. 1
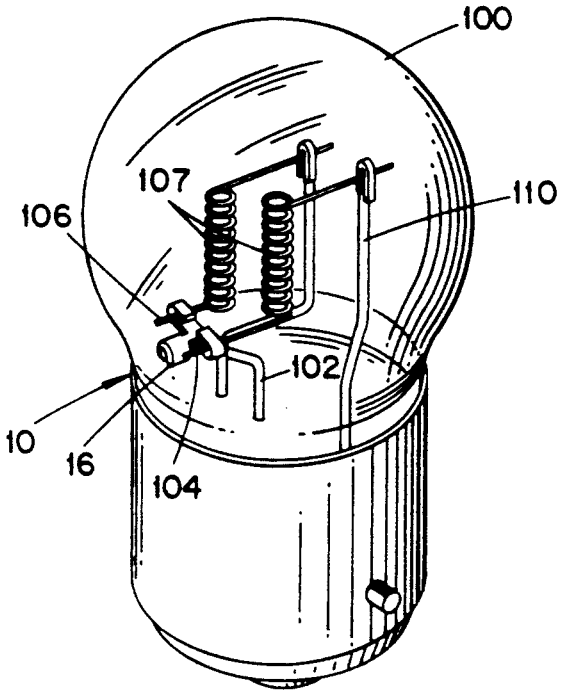
FIG. 2
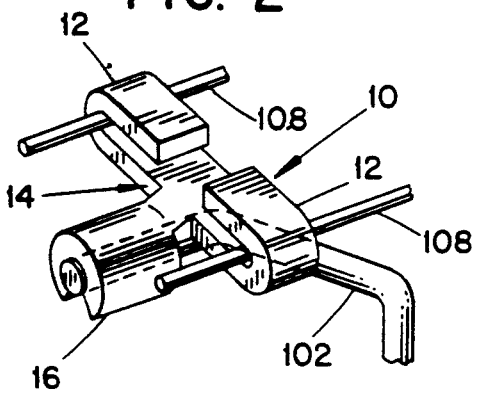
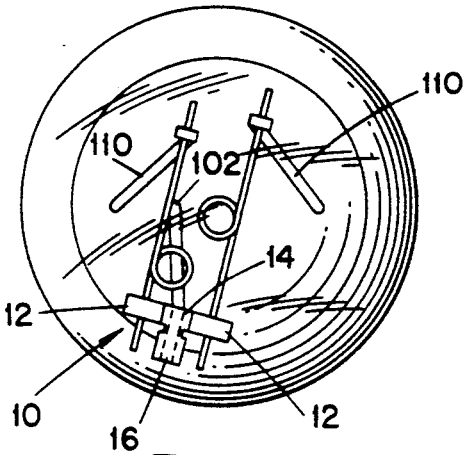
FIG. 3
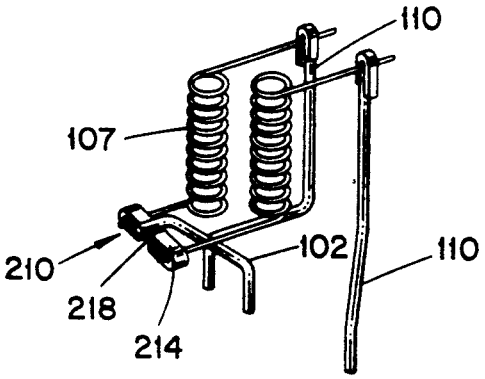
FIG. 4

FIG. 5
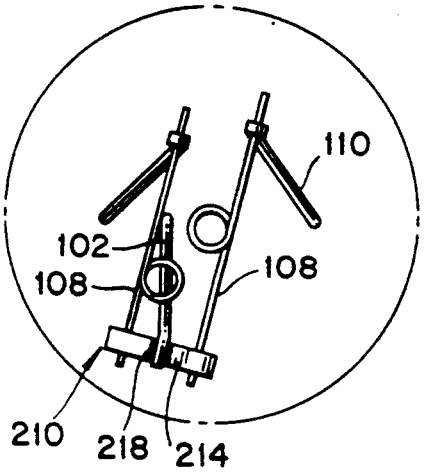
FIG. 6
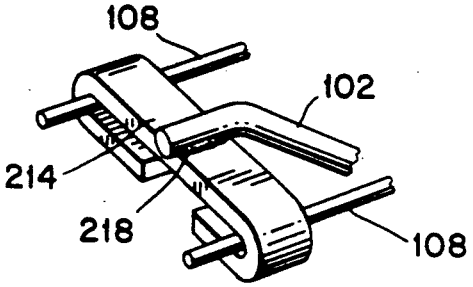
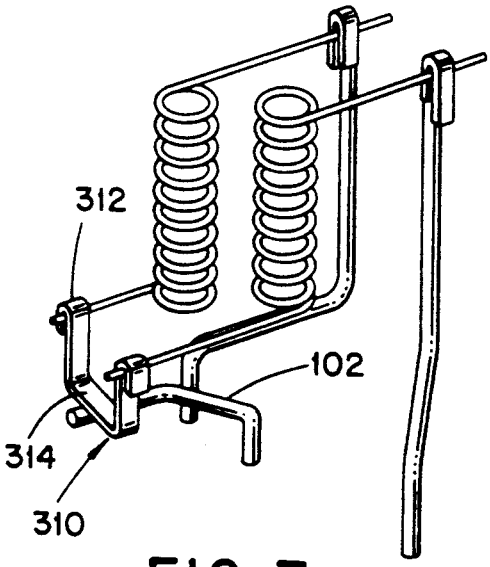
FIG. 7
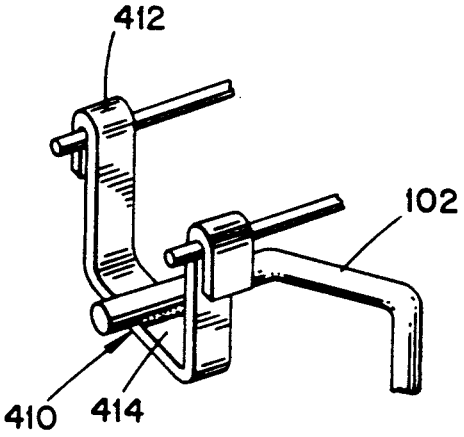
FIG. 8

FILAMENT ATTACHMENT METHOD FOR DUAL FILAMENT HALOGEN LAMP HAVING A COMMON GROUND CONNECTION

BACKGROUND OF THE INVENTION

The device of the present invention pertains to filament connecting systems for halogen lamps; more particularly the device of the present invention relates to filament connecting systems for dual filament halogen lamps having a common ground.

In order to provide electrical connections for dual filament halogen lamps having a common ground, it is necessary to provide a physical connection which conducts electricity between the various metals used in dual filament halogen lamps. Typically, halogen lamp filaments are made from tungsten and the leads which attach to the tungsten filaments are fabricated from molybdenum. In order to form a good electrical connection between the tungsten and the molybdenum, it has been common practice to wrap the ends of the tungsten filament with a molybdenum foil and then weld the molybdenum on the end of the filament to the molybdenum lead. This procedure is difficult and complex given the small size of electric halogen lamps and the difficulty of working with these metals. Such connection systems have become even more difficult in dual or multi-filament halogen lamps wherein the number of connections is multiplied by the number of filaments contained in the halogen lamp.

There is therefore a need in the art to provide a device which enables a quick, efficient and economical connection of tungsten halogen lamp filaments to the molybdenum leads.

SUMMARY OF THE INVENTION

A device for providing a single ground connection for a dual filament halogen lamp includes first and second clamping portions. First and second clamping portions are used to make an electrically conducting physical connection to the ends of tungsten filaments. Between the first and second clamping portions is a central portion which is constructed to be attached to the common ground lead. The central portion provides for either wrapping, clamping or welding of the device to the halogen lamp's common ground lead.

BRIEF DESCRIPTION OF THE DRAWINGS

A better understanding of the device of the present invention may be had by reference to the drawings wherein:

FIG. 1 is a perspective view of a dual filament halogen lamp including the device of the present invention;

FIG. 2 is an enlarged perspective view of one embodiment of the present invention;

FIG. 3 is a top plan view thereof;

FIG. 4 is a perspective view of a second embodiment of the present invention;

FIG. 5 is a top plan view of the embodiment shown in FIG. 4;

FIG. 6 is an enlarged perspective view of the embodiment shown in FIG. 4;

FIG. 7 is a perspective view of a third embodiment; and

FIG. 8 is a perspective view of a fourth embodiment.

DESCRIPTION OF THE EMBODIMENTS

By reference to FIGS. 1 and 2, it will be seen that the connection device 10 of the present invention is used in a dual filament halogen lamp 100 having a single ground connection 102.

The device 10 of the present invention is attached to the ends 104 of the filaments 106 in a dual filament halogen lamp 100 and to the single ground lead 102. Typically, the filaments 107 in a dual filament halogen lamp 100 are either connected to individual ground leads 102 or to a single ground lead 102. To assure electrical continuity between the molybdenum leads 110 and the tungsten filaments 107, the ends 104 and 104 of the tungsten filaments 107 in prior art halogen lamps have been wrapped with molybdenum foil.

Halogen lamp 100 is illuminated by passing electrical current through the tungsten filaments 107. An electrically conductive path is provided to tungsten filaments 107 by molybdenum power leads 110. The connection device 10 of the present invention is formed of molybdenum. The molybdenum electrical connector 10 is clamped on either side to the straight portion 108 of both the first and second filaments 104 and 106. As may be seen in the figures, first 12 and second clamping 12 portions are physically connected to the straight ends 108 of the tungsten filaments 107 The connection between the connector 10 and the ground lead 102 is made by either clamping, wrapping or welding the central portion 14 of the connection device 10 of the present invention to the ground lead 102.

In FIGS. 1, 2 and 3, a first embodiment of connection device 10 is shown. First and second clamping portions 12 are formed at either end of central portion 14. Extending from central portion 14 is semi-tubular section 16. Semi-tubular section 16 has sufficient internal diameter to slip over and form both an electrical and mechanical connection with ground lead 102 by wrapping or clamping.

In FIGS. 4, 5 and 6, ground lead 102 is shown welded 218 to the central portion 214 of connection device 210. Such welding eliminates the need for semi-tubular section 16 shown in FIGS. 1, 2 and 3.

In FIGS. 7 and 8, still other embodiments 310, 410 of clamping device are shown. Therein clamping portions 312, 412 are substantially perpendicular to central portion 314,414. Ground lead 102 may then be welded 318, 418 to either the top or bottom of central portions 314 or 414. If desired, a semi-tubular section 16 as shown in FIGS. 1, 2 and 3, may be used with the embodiments shown in FIGS. 7 and 8.

Those of ordinary skill in the art will realize that a wide variety of combinations of configurations are available to form connection device 10.

There is thereby provided by the device of the present invention a method for electrically connecting the filaments in the dual filament halogen lamp to a ground lead.

While the device of the present invention has been illustrated with respect to its preferred embodiment, it will be understood that a variety of other embodiments of the invention will become apparent to those of ordinary skill in the art given reference to this disclosure. Such embodiments are to be included within the scope of the appended claims.

I claim:

1. A halogen lamp comprising:

a sealed envelope forming an internal space;

a pair of power leads projecting into said space;

a single molybdenum ground lead having an end projecting into said space;

a pair of substantially linear tungsten filaments disposed in said space, each filament having first and second ends, said first ends being electrically connected to respective ones of said power leads; and a molybdenum electrical connector disposed in said space and comprised of an element separate from said power leads and said ground lead, said connector including:

a first clamping portion clamped to a second end of one of said filaments to form an electrical connection therewith, a second clamping portion clamped to a second end of the other of said filaments to form an electrical connection therewith, and a central third portion formed of one piece with said first and second portions and attached to said end of said ground lead.

2. The device as defined in claim 1 wherein said central portion is welded to the single ground lead.

3. The device as defined in claim 1 wherein said central portion is clamped to said single ground lead.

4. A method for connecting a single molybdenum ground lead to first and second substantially linear tungsten filaments of a dual filament halogen lamp comprising the steps of:

providing a one-piece molybdenum electrical connector which is separate from said filaments and said ground wire, clamping a first clamping portion of said connector to one end of said first filament, clamping a second clamping portion of said connector to one end of said second filament, and electrically connecting a central third portion of said connector to an end of said ground lead.

* * * * *